US007287609B2

(12) United States Patent
Runia et al.

(10) Patent No.: US 7,287,609 B2
(45) Date of Patent: Oct. 30, 2007

(54) DRILLING A BOREHOLE

(75) Inventors: Douwe Johannes Runia, Reeuwijk (NL); Eugene Andrew Murphy, Houston, TX (US)

(73) Assignee: Shell Oil Company, Houston, TX (US)

( * ) Notice: Subject to any disclaimer, the term of this patent is extended or adjusted under 35 U.S.C. 154(b) by 245 days.

(21) Appl. No.: 10/712,924

(22) Filed: Nov. 13, 2003

(65) Prior Publication Data

US 2004/0118611 A1 Jun. 24, 2004

Related U.S. Application Data

(60) Provisional application No. 60/426,648, filed on Nov. 15, 2002.

(51) Int. Cl.
*E21B 10/64* (2006.01)

(52) U.S. Cl. ..... 175/257; 175/262; 175/57

(58) Field of Classification Search ..... 175/57, 175/262, 257, 284, 61
See application file for complete search history.

(56) References Cited

U.S. PATENT DOCUMENTS

| | | | | |
|---|---|---|---|---|
| 3,052,838 | A * | 9/1962 | Bennett et al. | 324/347 |
| 3,112,442 | A * | 11/1963 | Bennett | 324/347 |
| 3,700,049 | A * | 10/1972 | Tiraspolsky et al. | 175/50 |
| 4,391,547 | A | 7/1983 | Jackson, Jr. et al. | |
| 5,078,650 | A | 1/1992 | Foote | |
| 5,244,050 | A * | 9/1993 | Estes | 175/393 |
| 5,560,437 | A | 10/1996 | Dickel et al. | |
| 5,667,023 | A * | 9/1997 | Harrell et al. | 175/45 |
| 5,931,239 | A * | 8/1999 | Schuh | 175/61 |
| 6,233,524 | B1 | 5/2001 | Harrell et al. | |
| 6,340,063 | B1 * | 1/2002 | Comeau et al. | 175/61 |
| 2005/0211471 | A1 * | 9/2005 | Zupanick | 175/57 |

FOREIGN PATENT DOCUMENTS

| | | |
|---|---|---|
| GB | 232521 | 4/1925 |
| GB | 2357787 | 4/2001 |
| WO | 00/17488 | 3/2000 |

OTHER PUBLICATIONS

Search Reported dated Nov. 13, 2003.

* cited by examiner

*Primary Examiner*—David Bagnell
*Assistant Examiner*—Daniel P Stephenson

(57) ABSTRACT

A method of drilling a borehole into a subsurface earth formation, using a tubular drill string which includes at its lower end a bottom hole assembly comprising a drill bit, a drill steering system, and a surveying system. The drill string includes a selectively closable passageway for passing an auxiliary tool from a first position interior of the drill string above the bottom hole assembly to a second position. In the second position, at least part of the auxiliary tool is exterior of the drill string below the bottom hole assembly. The drill string is progressed into the earth formation by drilling. When a tool operating condition is met the passageway is opened and the auxiliary tool is passed through the passageway from the first position to the second position, where the auxiliary tool is operated.

25 Claims, 5 Drawing Sheets

DRILLING A BOREHOLE

This application claims the benefit of U.S. Provisional Application No. 60/426,648 filed Nov. 15, 2002, the entire disclosure of which is hereby incorporated by reference.

FIELD OF THE INVENTION

The present invention relates to drilling a borehole into a subsurface earth formation. In particular, the present invention relates to drilling a borehole, wherein it is desired to drill the borehole along a predetermined curved trajectory. This is also referred to as directional drilling.

BACKGROUND OF THE INVENTION

In conventional drilling a drill string is used including a drill bit at its lower end, and progression into the earth is obtained by rotating the drill string while putting weight on the bit. In order to be able to perform directional drilling, a specialised so-called bottom hole assembly has to be used, which forms the lower part of the drill string. At minimum, in order to be suitable for directional drilling, a bottom hole assembly must comprise a drill bit, a drill steering system, and a surveying system. The drill bit forms the lower end of the drill string and is provided with cutting elements for progression into the earth formation. The drill steering system serves to point or push the drill bit into the desired direction. For this purpose, two different approaches are currently used, on the one hand rotary steering systems wherein the rotation of the drill bit is deflected into the desired direction while the entire drill string is rotated from surface, or mud motors in combination with bent subs or housings, wherein only the lower end of the drill string is rotated by the action of the mud motor. The surveying system can include a measurement-while-drilling (MWD) system and/or a logging-while drilling (LWD) system for determining orientation parameters in the course of the drilling operation and/or measuring parameters of the formation or in the borehole.

Directional drilling operations are becoming more and more important for the optimised production of oil or gas from subsurface formations. An example are so called 'Extended Reach' wells, which are wells which typically laterally extend up to 2 kilometers or more from the wellhead, with high angle or horizontal deviation. During drilling of such a borehole a plurality of situations and problems can be encountered which can require specialized equipment and tools at the lower end of the drill string to deal with. If the need for such specialised equipment is known in advance, it can sometimes be included in the bottom hole assembly. For example, the surveying system can include highly specialised logging tools for surveying a particular parameter of the surrounding formation or inside the borehole.

In this way, bottom hole assemblies used for directional drilling have developed to a high degree of complexity. Due to the high cost thereof, the risk of a loss of the bottom hole assembly in the borehole increases significantly. Also, it is impossible to include all equipment needed in unforeseen situations. For example, when suddenly mud losses are encountered, it may be desirable to seal fluid communication between borehole and the surrounding formation near the drill bit, but normally this cannot be done with the bottom hole assembly in place.

It is normally undesirable to pull the entire drill string up to surface, in order to replace the bottom hole assembly by, for example, a fluid injection tool (e.g. a cementing tool or a tool for injecting lost circulation material), or in general any other auxiliary tool. Pulling and running back in the drill string can be extremely time-consuming, in an extended reach well this can be a matter of several days. In some critical situations pulling the entire drill string up to surface is not be practically performable at all.

SUMMARY OF THE INVENTION

According to an embodiment of the present invention, there is provided a method of drilling a borehole into a subsurface earth formation, using a tubular drill string which includes at its lower end a bottom hole assembly comprising a drill bit, a drill steering system, and a surveying system, wherein the drill string includes a passageway for an auxiliary tool from a first position interior of the drill string above the bottom hole assembly to a second position wherein at least part of the auxiliary tool is exterior of the drill string below the bottom hole assembly, which passageway can be selectively closed, and which method comprises the steps of:

- drilling so as to progress the drill string into the earth formation, until a tool operating condition is met;
- opening the passageway;
- passing an auxiliary tool from the first position through the passageway to the second position, and operating the auxiliary tool at the second position.

In another embodiment of the invention a system is provided suitable for directionally drilling a borehole into a subsurface earth formation, which system comprises a tubular drill string including a bottom hole assembly at its lower end, which bottom hole assembly comprises a drill bit, a drill steering system, and a surveying system, and which bottom hole assembly is provided with a longitudinal internal passage so that the drill string forms a passageway for an auxiliary tool from a first position interior of the drill string above the bottom hole assembly to a second position wherein at least part of the auxiliary tool is exterior of the drill string below the bottom hole assembly, which part has a largest diameter of at least 5 cm, and wherein the bottom hole assembly comprises a removable closure element adapted to selectively close the passageway.

In another embodiment of the present invention, a bottom hole assembly attachable to a tubular drill string is provided, which bottom hole assembly comprises a drill bit, a drill steering system, and a surveying system, and which bottom hole assembly is provided with a longitudinal internal passage for at least part of an auxiliary tool, which part has a largest diameter of at least 5 cm.

According to a particular aspect of an embodiment of the present invention there is provided a mud motor comprising a tubular stator and a rotor arranged in the tubular stator, and a bit shaft which is arranged to be driven by the rotor and suitable for transmittal of torque to a drill bit, wherein the rotor is releasably connected to the bit shaft so that the rotor can be longitudinally removed from the stator after disconnection from the bit shaft.

The present invention therefore provides a method and apparatus which allow to perform a directional drilling operation, wherein an auxiliary tool can be deployed in the course of the drilling operation through the drill string, so that at least the lower part thereof reaches a position in the borehole ahead of the drill bit. It is therefore in most cases sufficient to start drilling with a relatively simple bottom hole assembly, since specialised tools can be brought to the bottom hole assembly whenever this is desired, without needing to pull the drill string out of the borehole. It has been found that useful auxiliary tools should have a diameter of 5 cm (2 inches) in the part that passes fully through the bottom hole assembly. In general the expression diameter is used in the description and in the claims to refer to the maximum cross-sectional extension in one dimension. Preferably, the passageway allows tools having a diameter of 6 cm, or 2.5 inch, to pass through, wherein the tools are substantially cylindrical and have a length of suitably longer than 2 meters, often 5 meters or more. The diameter thereby refers to the largest diameter of the part that passes fully through the passageway. Cementing tools for example can have a stinger extending into the borehole of 50 or 100 m long. Suitably the drill bit has a diameter between 15 and 30.5 cm, or 6 an 12 inch, preferably 8.5 inch.

For conventional rotary drilling applications without directional drilling functionality a number of systems have been proposed in the past for performing a logging operation in the borehole ahead of a drill bit.

U.S. Pat. No. 5,244,050 discloses a drill bit, which is internally provided with a passageway for a logging or sampling tool. The passageway opens towards the exterior of the drill bit through an eccentric port in the face of the bit body. The port can be selectively closed by a closure means, and in the region of the port no cutting elements or roller cones are arranged. Therefore, drilling performance is compromised.

International Patent Application with publication number WO 00/17488 discloses a system for drilling and logging of a wellbore. The system comprises a conventional tubular rotary drill string with a drill it at its lower end. The interior of the drill bit forms a passageway for a logging tool string, and drill bit is provided with a removable closure element at the lower end of the passageway.

However, such systems have so far only been used in combination with conventional rotary drilling, wherein no bottom hole assembly suitable for directional drilling has to be used.

The present invention is based on the insight, that it is possible to design a bottom hole assembly suitable for directional drilling such that an auxiliary tool can pass through, so as to reach the borehole ahead of the drill bit in the course of a drilling operation. It has been realised that, contrary to a general perception in the field, it is possible to provide all basic elements of the bottom hole assembly with a longitudinal passage that is large enough to allow passage of e.g. an elongated 2.5 inch tool through a 8.5 inch drill string and bottom hole assembly, without compromising on the practical applicability of the assembly.

The drill bit can be such designed that the outer shape is the same as of a conventional bit such as a PDC or a roller cone bit, and therefore provides the same drilling performance. The latter is particularly important in directional drilling applications.

MWD systems are known that consist of a tubular collar provided with a hang off device in the interior, wherein a surface retrievable probe can be arranged. However, standard MWD collars, after retrieval of probe, would typically only allow passage with a diameter of 1.5 inch or less, which is insufficient for the present invention. MWD tools can however be specially designed wherein the inner diameter of the hang-off device in the collar is maximized to allow the passage of e.g. a 2.5 inch tool.

Known drill steering systems also provide insufficient inner diameter, and this holds for both mud motor driven systems as well as rotary steering systems. It has been found possible however, to design both systems such that a sufficiently large passageway is provided.

BRIEF DESCRIPTION OF THE DRAWINGS

The invention will now be described in more detail and with reference to the drawings, wherein.

DETAILED DESCRIPTION OF THE INVENTION

Figure 1:
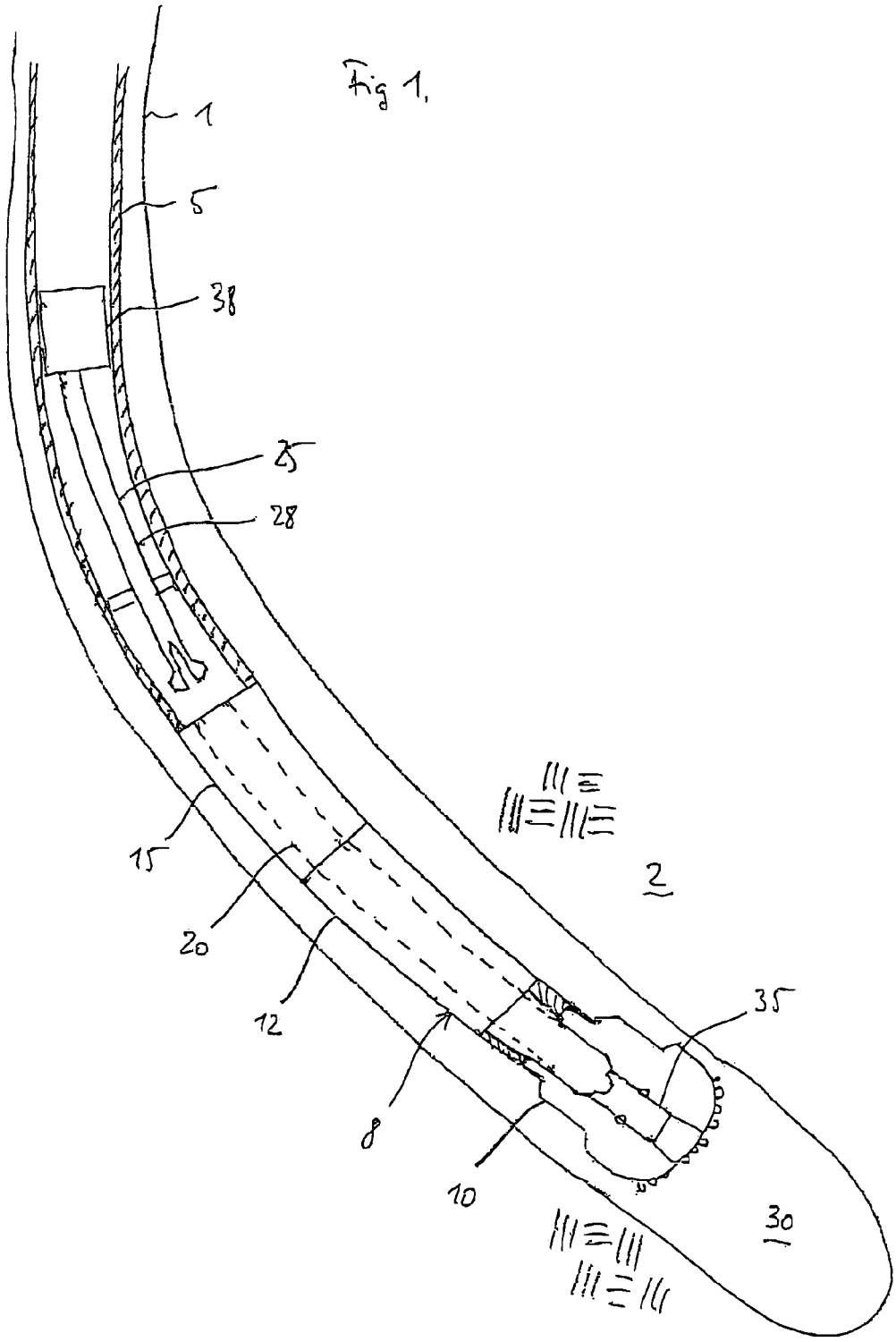
FIG. 1 shows a schematic overview of an embodiment of the present invention.

Reference is made to FIG. 1, showing a borehole 1 extending from surface (not shown) into an underground formation 2. The borehole 1 is deviated from the vertical, wherein the curvature in the Figure has been exaggerated for the sake of clarity. At least the lower part of the borehole that is shown in the Figure is formed by the operation of the tubular drill string 5. The lower end of the drill string 5 is referred to as a bottom hole assembly 8, which includes a drill bit 10, a drill steering system 12 and a surveying system 15. The bottom hole assembly is provided with a passage 20 forming part of a passageway for an auxiliary tool 25 between a first position 28 in the interior of the drill string, above the bottom hole assembly, and a second position 30 in the borehole 1 exterior of the drill string 5, below the bottom hole assembly and ahead of the drill bit 10. It shall be clear that the upper part of the auxiliary tool 25 can remain in the drill string, e.g. hung up in or even above the bottom hole assembly. For the present invention it is sufficient that the lower part of the auxiliary tool reaches the second position 30 in the borehole.

In the specification and in the claims, the terms upper and above are used to refer to a position or orientation relatively closer to the surface end of the drill string, and the terms lower and below for a position relatively closer to the end of the borehole during operation. The term longitudinal will be used to refer to a direction or orientation substantially along the axis of the drill string.

The drill bit 10 is provided with a releasably connected insert 35, which will be discussed in more detail with reference to FIG. 4. The insert forms a selectively removable closure element for the passageway 20, when it is in its closing position, i.e. connected to the drill bit as shown in the Figure.

FIG. 1 further shows a transfer tool 38 which is arranged at the upper end of the auxiliary tool 25, and which serves to deploy the auxiliary tool 25 from surface to the bottom hole assembly 8, e.g. by pumping. For example, a transfer tool as disclosed in UK patent application No. GB 2 357 787 A can be used for this purpose. A particularly suitable pumping tool for use in combination with the present invention is disclosed in co-pending European patent application No. EP 03076115.9, unpublished at the filing date of the present application.

Figure 2:
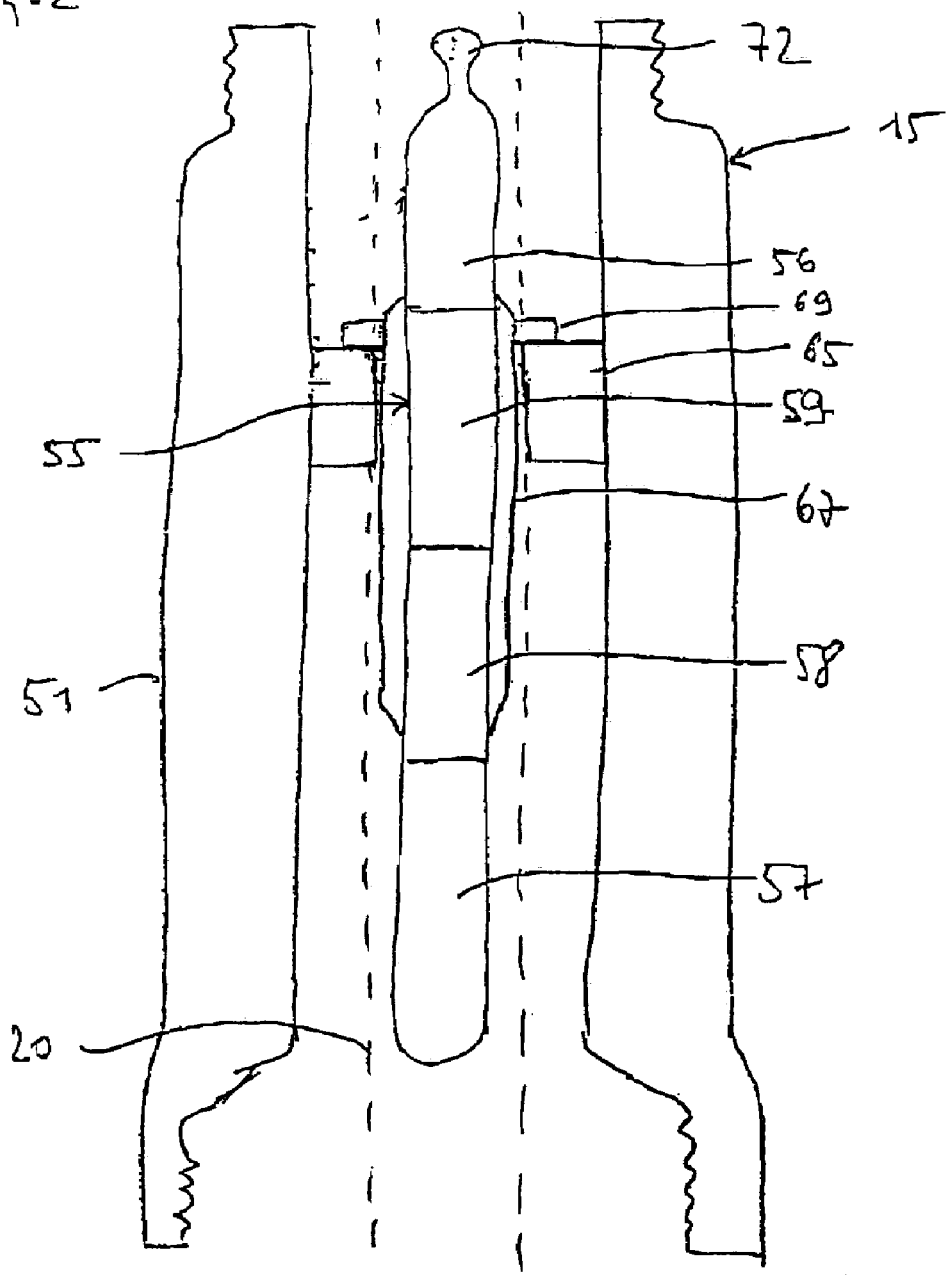
FIG. 2 shows a schematic drawing of the MWD survey system of FIG. 1.

Reference is now made to FIG. 2 showing schematically the surveying system 15 of FIG. 1. The surveying system of this embodiment is an MWD system comprising a tubular sub or collar 51 and an elongated probe 55. The upper end of the tubular sub 51 is connectable to the upper part of the drill string 5 extending to the surface, and the lower end is connectable to the steering system 12. The probe 55 contains surveying instrumentation, a gamma ray tool 56, an orientation tool 57 including e.g. an magnetometer and accelerometer for determining dip and azimuth of the borehole, a battery pack 58, and a mud pulser 59 for communication with the surface. The collar 51 can also contain surveying instrumentation. An annular shoulder 65 is arranged on the inner circumference of the tubular sub 51, on which the probe can be hung off. The outer surface of the probe is provided with notches 67 on which keys 69 are arranged that co-operate with the annular shoulder 65. The notches 67 allow for drilling fluid to flow through the MWD tool, and also induce the mud flow to go through the pulser section 59. The upper end of the probe 55 is arranged as a connection means 72 such as a fishing neck or a latch connector, which co-operates with a tool such as a wireline tool or a pumping tool that can be lowered from surface and connected to the connection means. The probe can thus be pulled or pumped upwardly so as to remove the probe 55 from the collar 51. The MWD system is dimensioned such that the interior of the collar 51 after removal of the probe 55 represents a passageway 20 of suitable size for passage of at least the lower part of an auxiliary tool according to the present invention.

Alternatively, a tubular MWD system can be designed, wherein all components are arranged around a central longitudinal passageway of required cross-section. In particular, a mud pulser can be provided that comprises an ring-shaped rubber member around the passageway, which can be inflated such that the rubber member extends into the passageway thereby creating a mud pulse.

It will be understood that communication means other than mud pulsers can be applied as well, e.g. electromagnetic communication means.

Figure 3:
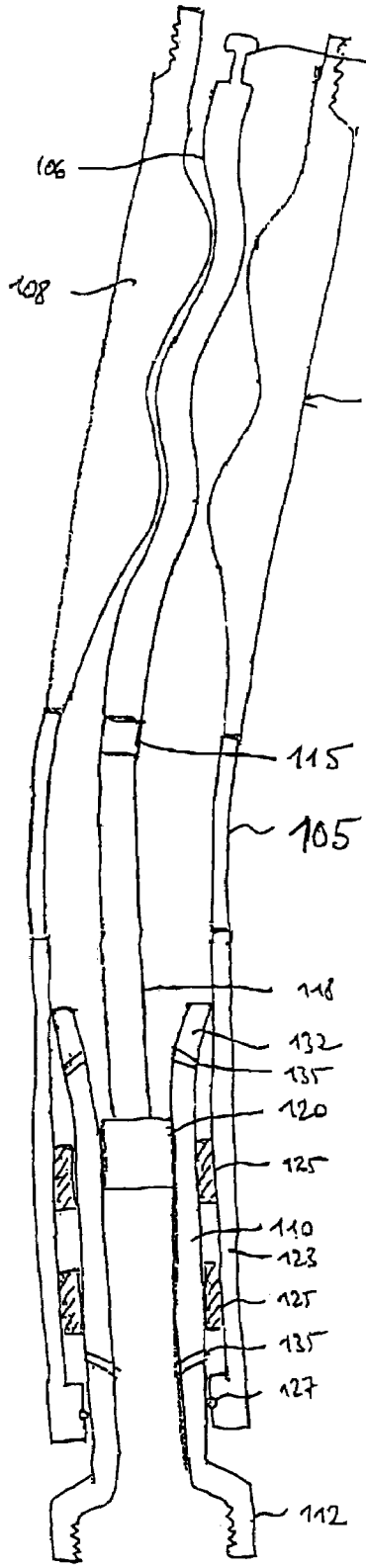
FIG. 3 shows a schematic drawing of the drill steering system of FIG. 1.

Reference is now made to FIG. 3 showing an embodiment of the drill steering system 12 of FIG. 1, in the form of a mud motor 104 in combination with a bent housing 105. The bent housing is shown with an exaggerated angle between the upper and lower ends, which in reality is normally in the order of less than 3 degrees. The bent housing 105 has an interior comparable to normal drill string. The upper end of the mud motor 104 will be directly or indirectly connected to the lower end of the surveying system 15.

A mud motor is a hydraulic motor that converts hydraulic energy from drilling mud pumped from the surface to mechanical energy at the bit. This allows for bit rotation without the need for drill string rotation. The mud motor schematically shown in FIG. 3 is a so-called positive displacement motor, which operates on the basis of the Moineau principle. The Moineau principle holds that a spiral-shaped rotor, shown at 106, with one or more lobes will rotate when it is placed eccentrically inside a stator 108 having one more lobe than the rotor, and when fluid is set to stream through annulus between stator and rotor.

The rotation is transferred to a tubular bit shaft 110, to the lower end 112 of which a drill bit can be connected. To transfer the rotation to the bit shaft 110, the lower end of the rotor 106 is connected via connection means 115 to one end of a transfer shaft 118. The transfer shaft extends through the bent housing 105 and is on its other end connected to the bit shaft via connection means 120. The transfer shaft can be a flexible shaft made from a material such as titanium that is able to withstand the torsion forces. Alternatively, the connection means 115 and 120 can be arranged as universal joints. The bit shaft 110 is suspended in a bit shaft collar 123, which is connected to or integrated with the stator 108, through bearings 125. A seal 127 is provided between bit shaft 110 and bit shaft collar 123.

The mud motor steering system of this embodiment differs from known systems in that the connection means 120 is arranged to release the connection between the transfer shaft 118 and the bit shaft 110 when upward force is applied to the rotor 106. For example, the connection means can be formed as co-operating splines on the lower end of the transfer tool and on the upper part of the bit shaft. A suitable latch mechanism that can be operated by longitudinal pulling/pushing is another option. In order to be able to apply upward force on the rotor 106, the upper end of the rotor is arranged as a connection means 130 such as a fishing neck or a latch connector, which co-operates with a tool that can be lowered from surface, connected to the connection means, and pulled or pumped upwardly so as to release the connection at connection means 120.

The upper end 132 of the bit shaft 110 is funnel-shaped so as to guide the lower end of the transfer tool 118 to the connection means 120 when the rotor 106 is lowered into the stator 108 again. Fluid passages 135 for drilling fluid can be provided through the wall of the bit shaft 110, to allow circulation of drilling fluid during drilling operation, when the rotor 106 is connected to the bit shaft 110 through connection means 120.

Suitably, there is also arranged a means (not shown) that locks the bit shaft 110 in the bit shaft collar 123 when the rotor 106 has been disconnected from the bit shaft 110.

It shall be clear that the minimum inner diameter of the stator 108 and the bit shaft 110 are dimensioned such that a sufficiently large longitudinal passageway for at least the lower part of an auxiliary tool is provided, forming part of the passageway 20 of FIG. 1, in accordance with the present invention.

An alternative drill steering system is generally known as rotary steering system. A rotary steering system allows to transfer rotation forces applied to the drill string at the surface around a bend. It generally consists of an outer tubular mandrel having the size of the normal drill string. Through the interior of the mandrel runs a piece of drill pipe of smaller diameter. The drill string or bottom hole assembly above the rotary steering system is connected to the upper end of this inner drill pipe, and the drill bit is connected to the lower end of the drill pipe. The mandrel comprises means to exert lateral force on the inner drill pipe so as to deflect the drill direction as desired. In order to be used with the present invention, the inner drill pipe of the rotary steering system must allow passage of an auxiliary tool.

Figure 4:
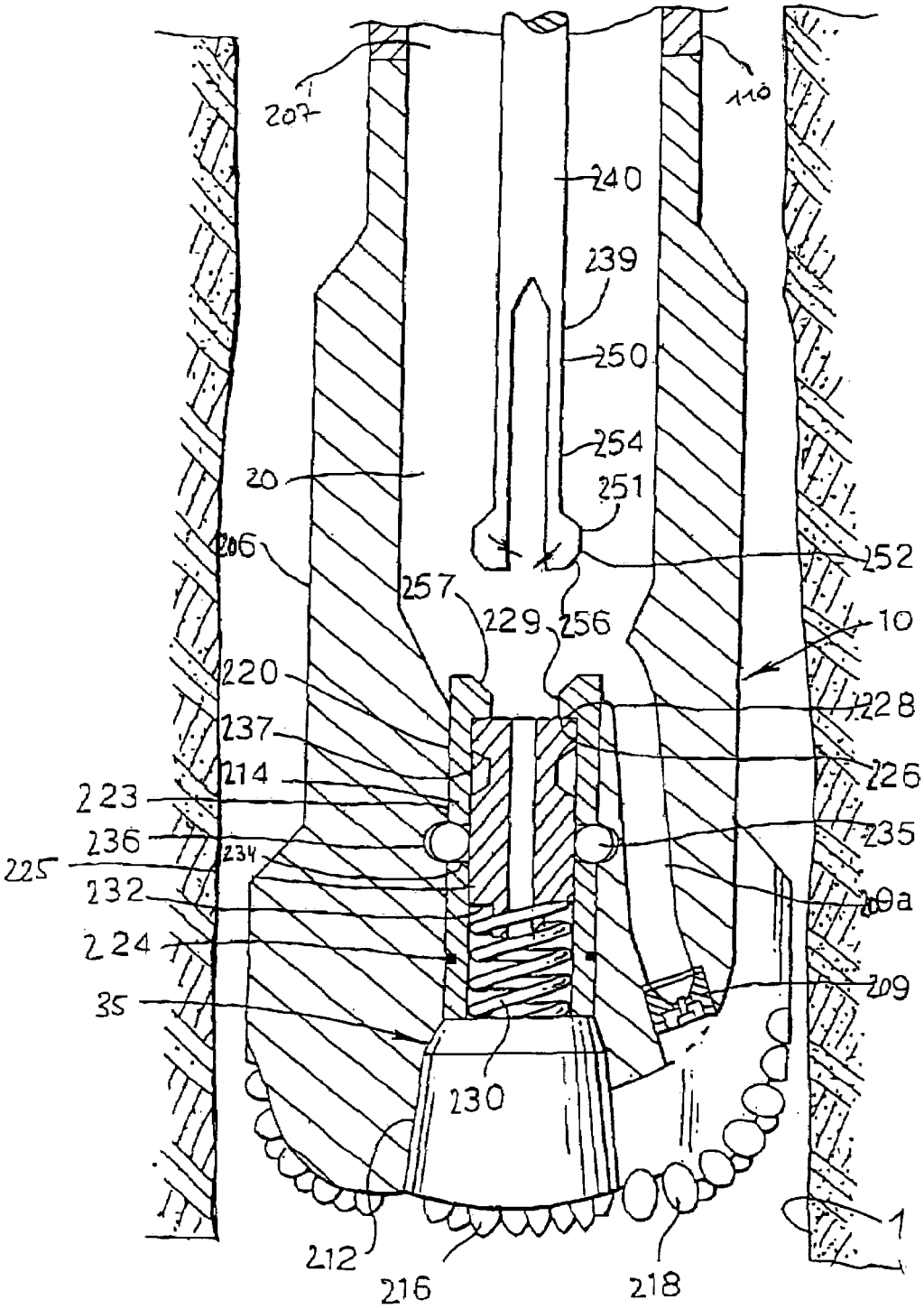
FIG. 4 shows a schematic drawing of the drill bit of FIG. 1.

Reference is now made to FIG. 4, showing schematically a longitudinal cross-section of an embodiment of the rotary drill bit 10 of FIG. 1. The drill bit 10 is shown in the borehole 2, and is attached in this embodiment to the lower end of the bit shaft 110 of FIG. 3. The bit body 206 of the drill bit 10 has a central longitudinal passage 20 for an auxiliary tool from the interior 207 of the drill string 3 to the borehole 1, 30, exterior of the drill bit 10, as will be pointed out in more detail below. Bit nozzles are arranged in the bit body 206. Only one nozzle with insert 209 is shown for the sake of clarity. The nozzle 209 is connected to the passageway 20 via the nozzle channel 209*a*.

The drill bit 10 is further provided with a removable closure element 35, which is shown in FIG. 4 in its closing position with respect to the passageway 20. The closure element 35 of this example includes a central insert section 212 and a latching section 214. The insert section 212 is provided with cutting elements 216 at its front end, wherein the cutting elements are arranged so as to form, in the closing position, a joint bit face together with the cutters 218 at the front end of the bit body 206. The insert section can also be provided with nozzles (not shown). Further, the insert section and the cooperating surface of the bit body 206 are shaped suitably so as to allow transmission of drilling torque from the bit shaft 110 and bit body 206 to the insert section 212.

The latching section 214, which is fixedly attached to the rear end of the insert section 212, has substantially cylindrical shape and extends into a central longitudinal bore 220 in the bit body 206 with narrow clearance. The bore 220 forms part of the passage 20, it also provides fluid communication to nozzles in the insert section 212.

Via the latching section 214 the closure element 35 is removably attached to the bit body 206. The latching section 214 of the closure element 35 comprises a substantially cylindrical outer sleeve 223 which extends with narrow clearance along the bore 220. A sealing ring 224 is arranged in a groove around the circumference of the outer sleeve 223, to prevent fluid communication along the outer surface of the latching section 214. Connected to the lower end of the sleeve 223 is the insert section 212. The latching section 214 further comprises an inner sleeve 225, which slidingly fits into the outer sleeve 223. The inner sleeve 225 is biased with its upper end 226 against an inward shoulder 228 formed by an inward rim 229 near the upper end of the sleeve 223. The biasing force is exerted by a partly compressed helical spring 230, which pushes the inner sleeve 225 away from the insert section 212. At its lower end the inner sleeve 225 is provided with an annular recess 232 which is arranged to embrace the upper part of spring 230.

The outer sleeve 223 is provided with recesses 234 wherein locking balls 235 are arranged. A locking ball 235 has a larger diameter than the thickness of the wall of the sleeve 223, and each recess 234 is arranged to hold the respective ball 235 loosely so that it can move a limited distance radially in and out of the sleeve 223. Two locking balls 235 are shown in the drawing, however it will be clear that more locking balls can be arranged.

In the closing position as shown in FIG. 4 the locking balls 235 are pushed radially outwardly by the inner sleeve 225, and register with the annular recess 236 arranged in the bit body 206 around the bore 220. In this way the closure element 35 is locked to the drilling bit 10. The inner sleeve 225 is further provided with an annular recess 237, which is, in the closing position, longitudinally displaced with respect to the recess 236 in the direction of the bit shaft 110.

The inward rim 229 is arranged to cooperate with a connection means 239 at the lower end of an opening tool 240. The connection means 239 is provided with a number of legs 250 extending longitudinally downwardly from the circumference of the opening tool 240. For the sake of clarity only two legs 250 are shown, but it will be clear that more legs can be arranged. Each leg 250 at its lower end is provided with a dog 251, such that the outer diameter defined by the dogs 251 at position 252 exceeds the outer diameter defined by the legs 250 at position 254, and also exceeds the inner diameter of the rim 229. Further, the inner diameter of the rim 229 is preferably larger or about equal to the outer diameter defined by the legs 250 at position 254, and the inner diameter of the outer sleeve 223 is smaller or approximately equal to the outer diameter defined by the dogs 251 at position 252. Further, the legs 250 are arranged so that they are inwardly elastically deformable as indicated by the arrows. The outer, lower edges 256 of the dogs 251 and the upper inner circumference 257 of the rim 229 are bevelled.

The outer diameter of the opening tool 240 is significantly smaller than the diameter of the bore 220.

Normal operation of the embodiment of FIGS. 1-4 will now be discussed.

The drill string 5 can be used for progressing the borehole 5 into the formation 2, when the MWD probe 55 hangs in the collar 51 as shown in FIG. 2, when the rotor 106 is arranged in the stator 108 of the mud motor 104 as shown in FIG. 3, and when the insert 35 is latched to the bit body 206 as shown in FIG. 4. The auxiliary tool would normally be stored at surface, but could also be stored in a side pocket mandrel in the drill string. The drill string can thus be used to drill the borehole into a desired direction. The probe 55, the rotor 106 and the insert 35 together form a closure element for the passageway 20.

In the course of the drilling operation a situation can be encountered, which requires the operation of the auxiliary tool 25 in the borehole ahead of the drill bit, position 30. This will be referred to as a tool operating condition in the specification and in the claims. Examples are the occurrence of mud losses which require the injection of fluids such as lost circulation material or cement, performing a cleaning operation in the open borehole, the desire to perform a special logging, measurement, fluid sampling or coring operation, the desire to drill a pilot hole.

Drilling is stopped then, the drill string is pulled up a certain distance to create sufficient space for the auxiliary tool at position 30, and the passageway is opened. To this end the MWD probe 55 and the rotor 106 are retrieved to surface, e.g. by using a fishing tool with a connector means at its lower end, that can be pumped down through the drill string and pulled up again by wireline. Retrieving of the MWD probe and the rotor can be done in consecutive steps. The lower end of the probe can also be arranged so that it can be connected to the connection means 130 at the upper end of the rotor 106, so both can be retrieved at the same time.

The opening tool 240 can then be deployed, through the interior of the drill string, so as to outwardly remove the closure element 35 from bit body 206. The opening tool 240 suitably forms the lower end of the auxiliary tool 25. The auxiliary tool is suitably deployed from surface by pumping, with the transfer tool 38 connected to the upper end. The auxiliary tool passes though the drill string and the passageway 20 of the bottom hole assembly 8, i.e. consecutively through the MWD collar 51, the stator 108 of the mud motor, until the upper end of the drill bit 10, so that the connection means 239 engages the upper end of the latching section 214 of the closure element 35. The dogs 251 slide into the upper rim 229 of the outer sleeve 223. The legs 250 are deformed inwardly so that the dogs can slide fully into the upper rim 229 until they engage the upper end 226 of the inner sleeve 225. By further pushing down, the inner sleeve 225 will be forced to slide down inside the outer sleeve 223, further compressing the spring 230. When the space between the upper end 226 of the inner sleeve 225 and the shoulder 228 has become large enough to accommodate the length of the dogs 251, the legs 250 snap outwardly, thereby latching the opening tool to the closure element.

At approximately the same relative position between inner and outer sleeves, where the legs snap outwardly, the recesses 237 register with the balls 235, thereby unlatching the closure element 35 from the bit body 206. At further pushing down of the opening tool the closure element is integrally pushed out of the bore 220.

When the closure element has been fully pushed out of the bore 220, the passageway 20 is opened.

By progressing the opening tool 240 further, the lower part of the auxiliary tool 25 at the upper end of the opening tool enters the open borehole exterior of the drill bit, and it can be operated there. In this embodiment the auxiliary tool is long enough so that it extends through the entire bottom hole assembly and remains connected to the transfer tool 38 above the bottom hole assembly. This allows straightforward retrieval of the auxiliary tool to surface, by wireline or reverse pumping.

Figure 5:
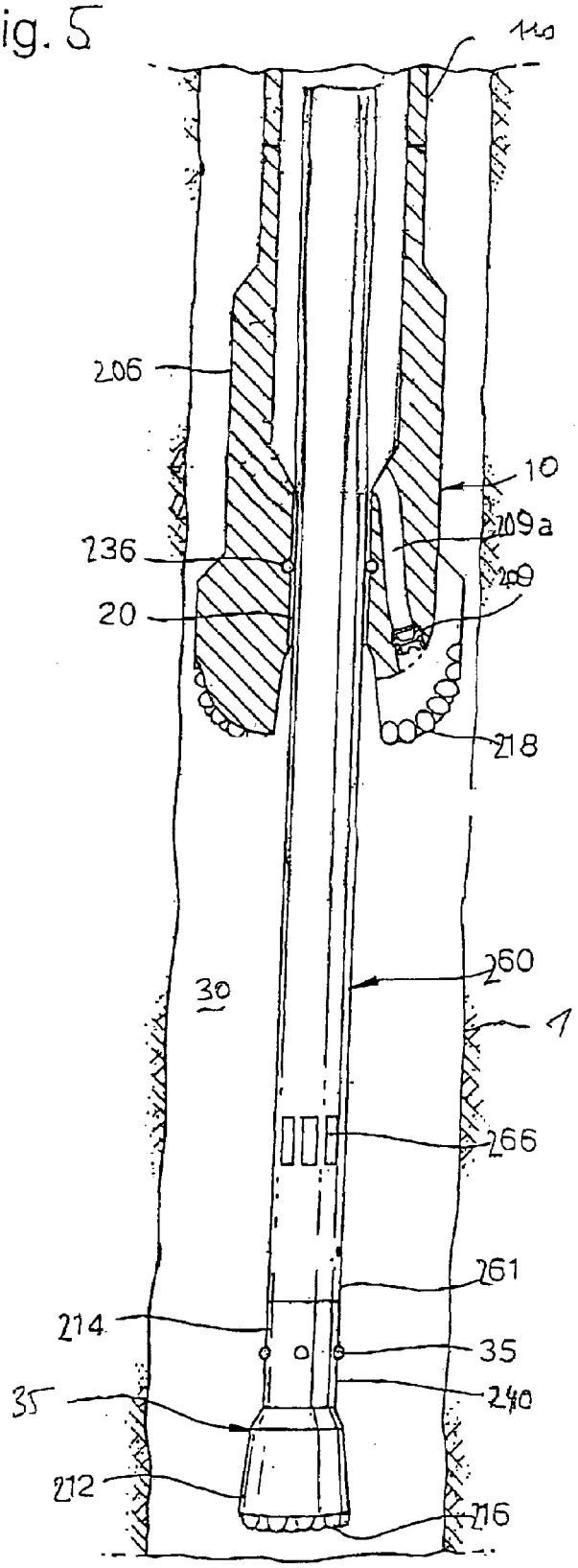
FIG. 5 shows a schematic drawing of logging tool that has been passed through the bottom hole assembly to extend into the borehole ahead of the drill string. Like reference numerals are used in the Figures to refer to the same or similar parts.

FIG. 5 shows the lower end of the drill bit 10 in the situation that a logging tool 260, of which the lower part 261 has been passed through the passageway. The closure element 35 has been outwardly removed from the closing position by the opening tool 240 at the lower end of the logging tool 260.

A number of sensors or electrodes of the logging tool are shown at 266. They can be activated battery-powered, or through a wireline extending to surface. Data can be stored in the tool or transmitted to surface. The logging tool 260 further comprises a landing member (not shown) having a landing surface, which cooperates with a landing seat of the bottom hole assembly 8.

The drill bit 10 can for example have an outer diameter of 21.6 cm (8.5 inch), with a passageway of 6.4 cm (2.5 inch). The lower part 261 of the logging tool, which is the part that has passed out of the drill string onto the open borehole, is in this case substantially cylindrical and has an relatively uniform outer diameter of 5 cm (2 inch).

After the auxiliary tool has been operated in the borehole at 30, it can be retrieved into the drill string by pulling up the transfer tool 38. The insert 35 will then reconnect to the bit body 206. The opening tool 240 will disconnect from the insert 35, and the auxiliary tool 260 can be fully retrieved to the surface. Rotor 106 and MWD probe 55 can be lowered into the mud motor and MWD stator 108, respectively, so that the closure element is complete again, and drilling can be resumed. If a following tool operation condition occurs, the whole cycle can start over again, wherein in particular a different auxiliary tool can be used. The flexibility gained in this way during a directional drilling operation is a particular advantage of the present invention.

An alternative drill bit assembly of bit body, insert section and auxiliary tool for selectively connecting to the insert section and removing the insert section from the bit body is described in co-pending European patent application No. EP 03250243.7, unpublished at the filing date of the present application. An advantage of this alternative assembly is that allows robust and fail-safe operation of the latching mechanism during both disconnecting and re-connecting.

We claim:

1. A method of drilling a borehole into a subsurface earth formation using a tubular drill string which includes at its lower end a bottom hole assembly comprising a drill bit, a drill steering system, and a surveying system, wherein the drill steering system is provided in the form of a mud motor comprising a tubular stator and a rotor arranged in the tubular stator, and a bit shaft which is arranged to be driven by the rotor and suitable for transmittal of torque to a drill bit, wherein the rotor is releasably connected to the bit shaft so that the rotor can be longitudinally removed from the stator after disconnection from the bit shaft, wherein the drill string includes a passageway for an auxiliary tool from a first position interior of the drill string above the bottom hole assembly to a second position wherein at least part of the auxiliary tool is exterior of the drill string below the bottom hole assembly, which passageway can be selectively closed, part of the passageway being formed by the interior of the stator, and which method comprises the steps of:

drilling so as to progress the drill string into the earth formation, until a tool operating condition is met;

opening the passageway;

passing an auxiliary tool from the first position through the passageway to the second position, and operating the auxiliary tool at the second position.

2. The method according to claim 1, further comprising the steps of closing the passageway, and continuing drilling.

3. The method according to claim 2, wherein closing the passageway comprises retrieving the auxiliary tool fully into the drill string.

4. The method according to claim 1, wherein the auxiliary tool is selected from the group consisting of a logging tool, a fluid injection tool, a sampling tool, a pilot drilling tool.

5. The method according to claim 1, wherein in the course of a drilling operation at least two different auxiliary tools are deployed through the drill string and operated external of the drill string.

6. The method according to claim 1, wherein the part of the auxiliary tool that is passed to the second position has a largest diameter of at least 5 cm.

7. The method according to claim 1, wherein opening the passageway comprises releasing the rotor from the bit shaft and thereafter removing the rotor from the stator.

8. The method according to claim 1, wherein passing the auxiliary tool through the passageway comprises passing the auxiliary tool through the stator of the mud motor.

9. A method of drilling a borehole into a subsurface earth formation using a tubular drill string which includes at its lower end a bottom hole assembly comprising a drill bit, a drill steering system, and a surveying system, wherein the drill string includes a passageway for an auxiliary tool from a first position interior of the drill string above the bottom hole assembly to a second position wherein at least part of the auxiliary tool is exterior of the drill string below the bottom hole assembly, which passageway can be selectively closed using a closure element, and which method comprises the steps of:

drilling so as to progress the drill string into the earth formation, until a tool operating condition is met;

opening the passageway, wherein opening the passageway comprises retrieving at least part of the closure element to surface;

passing an auxiliary tool from the first position through the passageway to the second position, and operating the auxiliary tool at the second position.

10. A system suitable for directionally drilling a borehole into a subsurface earth formation, which system comprises a tubular drill string including a bottom hole assembly at its lower end, which bottom hole assembly comprises a drill bit, a drill steering system, and a surveying system, and which bottom hole assembly is provided with a longitudinal internal passage so that the drill string forms a passageway for an auxiliary tool from a first position interior of the drill string above the bottom hole assembly to a second position wherein at least part of the auxiliary tool is exterior of the drill string below the bottom hole assembly, and wherein the bottom hole assembly comprises a removable closure element adapted to selectively close the passageway, wherein the bottom hole assembly includes a mud motor comprising a tubular stator wherein a rotor is arranged, wherein the interior of the stator forms part of the passageway, and wherein the closure element includes the rotor.

11. The system according to claim 10, wherein the closure element comprises a surface retrievable part.

12. The system according to claim 11, wherein the surface retrievable part of the closure element includes the rotor.

13. The system according to claim 10, wherein there is further provided a pumpable transport tool for transporting the auxiliary tool from the position inside the drill string to the position wherein at least part of the auxiliary tool is exterior of the drill string.

14. The system according to claim 10, wherein the part of the auxiliary tool has a largest diameter of at least 5 cm.

15. A system suitable for directionally drilling a borehole into a subsurface earth formation, which system comprises a tubular drill string including a bottom hole assembly at its lower end, which bottom hole assembly comprises a drill bit, a drill steering system, and a surveying system, and which bottom hole assembly is provided with a longitudinal internal passage so that the drill string forms a passageway for an auxiliary tool from a first position interior of the drill string above the bottom hole assembly to a second position wherein at least part of the auxiliary tool is exterior of the drill string below the bottom hole assembly, and wherein the bottom hole assembly comprises a removable closure element adapted to selectively close the passageway, wherein the surveying system comprises a tubular sub wherein a probe is arranged, wherein the interior of the tubular sub forms part of the passageway for the auxiliary tool, and wherein the closure element includes the probe.

16. The system according to claim 15, wherein the drill steering system is a rotary steering system.

17. The system according to claim 15, wherein the surveying system has the form of a tubular sub, and wherein the interior of the tubular sub forms part of the passageway for the auxiliary tool.

18. The system according to claim 15, wherein there is further provided a pumpable transport tool for transporting the auxiliary tool from the position inside the drill string to the position wherein at least part of the auxiliary tool is exterior of the drill string.

19. The system according to claim 15, wherein the part of the auxiliary tool has a largest diameter of at least 5 cm.

20. The system according to claim 15, wherein the closure element comprises a surface retrievable part, which surface retrievable part includes the probe.

21. The method of claim 20, wherein opening the passageway comprises retrieving at least the rotor to surface.

22. A bottom hole assembly attachable to a tubular drill string, which bottom hole assembly comprises a drill bit, a drill steering system, and a surveying system, and which bottom hole assembly is provided with a longitudinal internal passage for at least part of an auxiliary tool, wherein the drill steering system is provided in the form of a mud motor comprising a tubular stator and a rotor arranged in the tubular stator, and a bit shaft which is arranged to be driven by the rotor and suitable for transmittal of torque to a drill bit, whereby the interior of the stator forms part of the longitudinal internal passage, wherein the rotor is releasably connected to the bit shaft so that the rotor can be longitudinally removed from the stator after disconnection from the bit shaft.

23. The bottom hole assembly according to claim 22, wherein longitudinal internal passage affords a passageway through the bottom hole assembly for the part of the auxiliary tool from a first position above the bottom hole assembly to a second position wherein at least the part of the auxilliary tool is below the bottom hole assembly.

24. The bottom hole assembly according to claim 22, wherein the part of the auxiliary tool has a largest diameter of at least 5 cm.

25. The bottom hole assembly according to claim 24, wherein the part of the auxiliary tool that has a diameter of at least 5 cm passes fully through the bottom hole assembly.

* * * * *